US010590865B2

(12) United States Patent
Sharp

(10) Patent No.: US 10,590,865 B2
(45) Date of Patent: Mar. 17, 2020

(54) METHODS AND SYSTEMS FOR CONTROLLING MACHINE SPEED

(71) Applicant: Caterpillar Inc., Deerfield, IL (US)

(72) Inventor: Jeremy T. Sharp, St. Charles, IL (US)

(73) Assignee: Caterpillar Inc., Peoria, IL (US)

( * ) Notice: Subject to any disclaimer, the term of this patent is extended or adjusted under 35 U.S.C. 154(b) by 26 days.

(21) Appl. No.: 15/965,179

(22) Filed: Apr. 27, 2018

(65) Prior Publication Data

US 2019/0331033 A1 Oct. 31, 2019

(51) Int. Cl.
*F02D 13/04* (2006.01)
*F01L 13/06* (2006.01)

(52) U.S. Cl.
CPC ..... *F02D 13/04* (2013.01); *F01L 13/065* (2013.01)

(58) Field of Classification Search
CPC ..... F02D 13/04; F01L 13/065
USPC .... 123/320, 321, 198 F, 481, 90.15; 701/65, 701/70, 110
See application file for complete search history.

(56) References Cited

U.S. PATENT DOCUMENTS 7,134,985 B2 11/2006 Watanabe et al.
8,950,378 B2 2/2015 Holt et al.
2011/0125376 A1 5/2011 Chappell et al.

FOREIGN PATENT DOCUMENTS

JP H06135260 5/1994

*Primary Examiner* — Hai H Huynh
(74) *Attorney, Agent, or Firm* — Schwegman, Lundberg & Woessner

(57) ABSTRACT

A machine includes an engine, one or more machine retarder systems, a grade sensor, a load sensor, and a controller. Each of the retarder systems has a retarding capability including an amount of energy the respective retarder system can dissipate in one or more systems of the machine powering or transmitting power to propel the machine. The grade sensor is configured to measure a grade at which the machine is disposed. The load sensor configured to measure a load on the machine. The controller is in electrical communication with the engine, the one or more retarder systems, the grade sensor, and the load sensor. The controller determines a machine speed limit based on the grade, the load and the retarding capability of each of the one or more retarder systems.

20 Claims, 4 Drawing Sheets

METHODS AND SYSTEMS FOR CONTROLLING MACHINE SPEED

BACKGROUND

Some heavy machinery, for example, agricultural, industrial, construction or other heavy machinery include systems for slowing the rate of travel of the machine without application of the brakes. An example of such systems/functions is sometimes referred to as engine braking, which is only one type of what may be more generally referred to as a speed retarder system.

SUMMARY

An example machine includes an engine, one or more machine retarder systems, a grade sensor, a load sensor, and a controller. Each of the retarder systems has a retarding capability including an amount of energy the respective retarder system can dissipate in one or more systems of the machine powering or transmitting power to propel the machine. The grade sensor is configured to measure a grade at which the machine is disposed. The load sensor is configured to measure a load on the machine. The controller is in electrical communication with the engine, the one or more retarder systems, the grade sensor, and the load sensor. The controller determines a retarder speed limit based on the grade, the load and the retarding capability of each of the one or more retarder systems. The retarder speed limit is a speed of the machine that can be maintained by actuation of the one or more retarder systems without actuating a machine braking system.

An example method of operating a machine includes: determining a grade at which the machine is disposed using a grade sensor coupled to the machine; determining a load of the machine using a load sensor coupled to the machine; and determining, by a controller in communication with one or more retarder systems, the grade sensor, and the load sensor, a retarder speed limit based on the grade, the load and a retarding capability of each of the one or more retarder systems. The retarding capability of each of the one or more retarder systems is an amount of energy the respective retarder system can dissipate in one or more systems of the machine powering or transmitting power to propel the machine. The retarder speed limit is equal to a speed of the machine that can be maintained by actuation of the one or more retarder systems without actuating a machine braking system.

An example machine includes an engine, one or more machine retarder systems, a grade sensor, a load sensor, and an electronic control unit (ECU). Each of the one or more machine retarder systems has a retarding capability comprising an amount of energy the respective retarder system can dissipate in one or more systems of the machine powering or transmitting power to propel the machine. The grade sensor is configured to generate one or more grade signals indicative of a grade at which the machine is disposed. The load sensor is configured to generate one or more load signals indicative of a load on the machine. The electronic control unit (ECU) is configured to: receive the one or more grade signals, the one or more load signals, and receive or retrieve the retarding capability of each of the one or more retarder systems; determine a retarder speed limit based on the grade signals, the load signals and the retarding capability of the one or more retarder systems; and automatically limit a speed of the machine to the determined retarder speed limit using the one or more machine retarder systems without actuating the machine braking system.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Machines, including on and off-highway haul and vocational trucks, wheel loaders, motor graders, and other types of heavy machinery generally include a multi-speed, bidirectional, automatic transmission drivingly coupled to an engine Such machines also include one or more braking mechanisms, such as service brakes associated with the wheels of the machine, to controllably decelerate the machine when braking is required.

In addition to the brakes, machines can include additional speed retarder systems. Examples of speed retarder systems include engine fan retarding, hydraulic pumps retarding, transmission retarding, engine retarding, among other examples. For example, the engine can be used to assist the service brakes in slowing the machine's travel, because the engine output and transmission input shafts are mechanically coupled, and, as such, during an "engine braking" operation, power can be transferred from the wheels of the machine through the transmission to drive the engine. The natural resistance of the engine may dissipate some of the transferred power, thereby slowing the machine.

Because such machines typically require the use of a separate pedal or other operator interface device to actuate and control on-board retarding system(s), it can be difficult for machine operators to utilize engine or exhaust braking, for example, in conjunction with the service brakes of the machine, in situations where such augmented machine braking is desired. Additionally, some machines can include multiple speed retarding systems and the actuation and selection of these systems under different circumstances may present additional operational challenges. Moreover, there may be circumstances under which it is desirable, advantageous and/or beneficial to control the speed of the machine using on-board retarding system(s) without actuation of the machine brakes.

Examples according to this disclosure are directed to devices, systems and methods for automatically controlling the speed of a machine using one or more speed retarding systems and without application of the machine brakes. A retarder speed limit of the machine can be determined and set by one or more control systems of the machine based on the grade at which the machine is oriented, the load of the machine and a retarding capability of each of the speed retarding systems. The retarder speed limit can be equal to a speed that can be maintained by actuation of the one or more retarder systems without actuating a machine braking system. The retarding capability of a speed retarding system can be an amount of energy the retarding system can dissipate in one or more machine systems powering or transmitting power to propel the machine.

Figure 1:
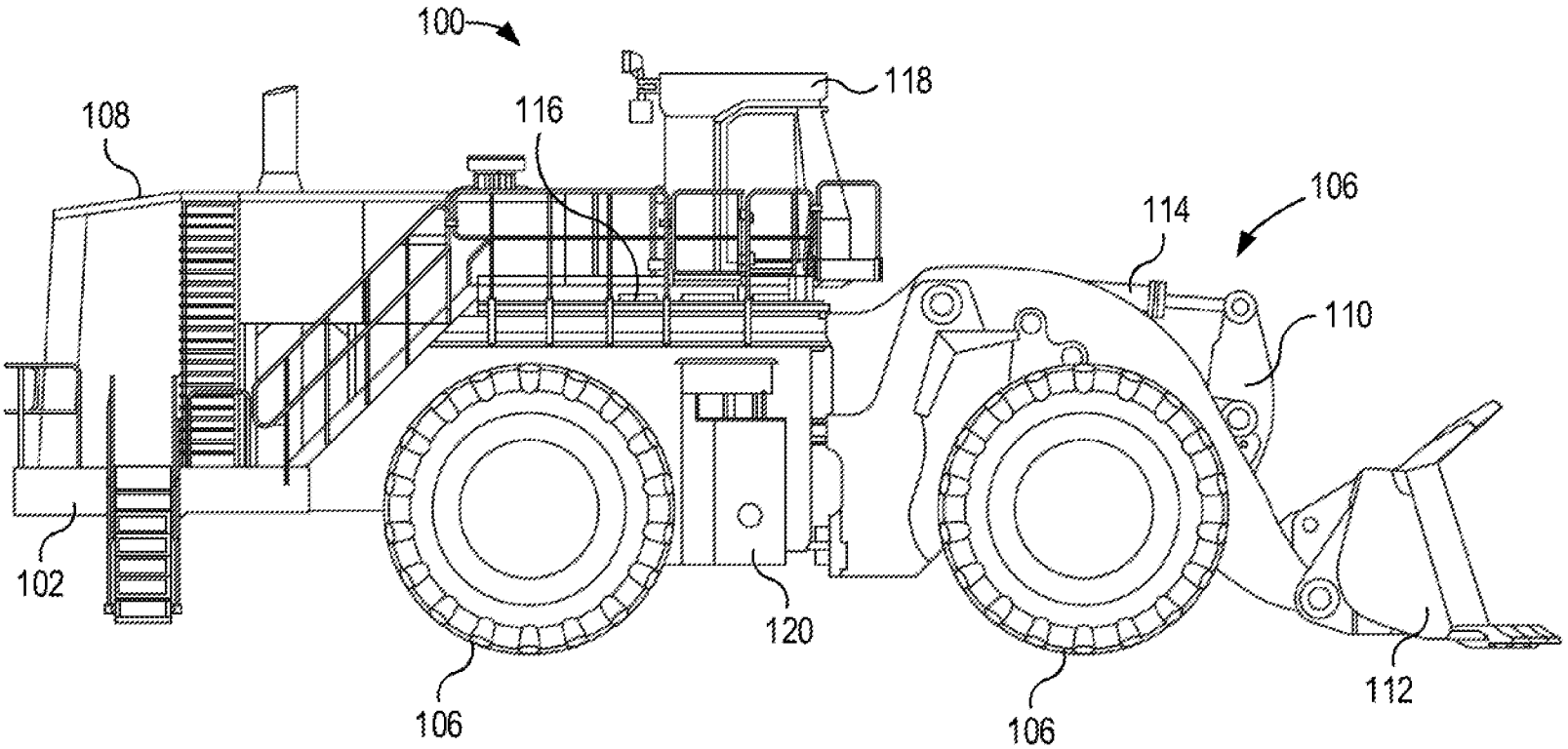
FIG. 1 is an elevation view depicting an example machine in accordance with this disclosure.

FIG. 1 depicts an example machine 100 in accordance with this disclosure. In FIG. 1, machine 100 includes frame 102, wheels 104, implement 106, and a speed control system implemented in one or more on-board electronic devices like, for example, an electronic control unit or ECU. Example machine 100 is a wheel loader. In other examples, however, the machine may be other types of machines related to various industries, including, as examples, construction, agriculture, forestry, transportation, material handling, waste management, and so on. Accordingly, although a number of examples are described with reference to a wheel loader machine, examples according to this disclosure are also applicable to other types of machines including graders, scrapers, dozers, excavators, compactors, material haulers like dump trucks, along with other example machine types.

Machine 100 includes frame 102 mounted on four wheels 104, although, in other examples, the machine could have more than four wheels. Frame 102 is configured to support and/or mount one or more components of machine 100. For example, machine 100 includes enclosure 108 coupled to frame 102. Enclosure 108 can house, among other components, an engine and/or other drive system to propel the machine over various terrain via wheels 106. The engine can include various power generation platforms, including, for example, an internal combustion engine, whether gasoline or diesel.

Machine 100 includes implement 106 coupled to the frame 102 through linkage assembly 110, which is configured to be actuated to articulate bucket 112 of implement 110. Bucket 112 of implement 106 may be configured to transfer material such as, soil or debris, from one location to another. Linkage assembly 110 can include one or more cylinders 114 configured to be actuated hydraulically or pneumatically, for example, to articulate bucket 112. For example, linkage assembly 110 can be actuated by cylinders 114 to raise and lower and/or rotate bucket 112 relative to frame 102 of machine 100.

Platform 116 is coupled to frame 102 and provides access to various locations on machine 100 for operational and/or maintenance purposes. Machine 100 also includes an operator cabin 118, which can be open or enclosed and may be accessed via platform 114. Operator cabin 118 may include one or more control devices (not shown) such as, a joystick, a steering wheel, pedals, levers, buttons, switches, among other examples. The control devices are configured to enable the operator to control machine 100 and/or the implement 106. Operator cabin 118 may also include an operator interface such as, a display device, a sound source, a light source, or a combination thereof.

Machine 100 can include a tank compartment connected to frame 102 and including fuel tank 120. Fuel tank 120 is fluidly coupled to the engine. Tank 120 is configured to store a fuel therein and serve as a source for supply of the fuel to the engine of machine 100. Machine 100 may also include other tanks, for example, to store and supply hydraulic fluid to implement 106 or other components of machine 100.

Machine 100 can be used in a variety of industrial, construction, commercial or other applications. Machine 100 can be operated by an operator in operator cabin 118. The operator can, for example, drive machine 100 to and from various locations on a work site and can also pick up and deposit loads of material using bucket 112 of implement 106. As an example, machine 100 can be used to excavate a portion of a work site by actuating cylinders 114 to articulate bucket 112 via linkage 100 to dig into and remove dirt, rock, sand, etc. from a portion of the work site and deposit this load in another location.

As machine 100 moves from various locations, the machine may be required to traverse various grades including downhill or decline grades. As the weight of machine 100 and the loads thereon can be large, application of the service brakes of machine 100 can cause rapid wearing of the brake system, especially when applying the brakes on a downhill grade. To extend brake life and to provide additional means of controlling speed, machine 100 can include a number of speed retarder systems, which are configured to retard the speed of the machine independent of use of the brakes to control machine speed.

As noted above, machine 100 includes a speed control system that is configured to automatically control the speed at which machine 100 moves. Machine 100 includes the engine, the speed retarder system(s), and can also include a grade sensor configured to measure a grade at which the machine is disposed and a load sensor configured to measure a load on the machine. Each of the retarder systems has a retarding capability that can be equal to an amount of energy the respective retarder system can dissipate in one or more systems of the machine powering or transmitting power to propel the machine, for example, the engine and transmission.

The speed control system of machine 100 is in electrical communication with the engine, the one or more retarder systems, the grade sensor, and the load sensor. The speed control system can also be in communication with other components of machine 100, including, for example, a transmission operatively coupled to the engine. The speed control system can be configured to determine a retarder speed limit based on the grade, the load and the retarding capability of each of the one or more retarder systems and can also be configured to automatically limit the speed of machine 100 to the determined retarder speed limit using the one or more machine retarder systems without actuating the braking system of machine 100.

Figure 2:
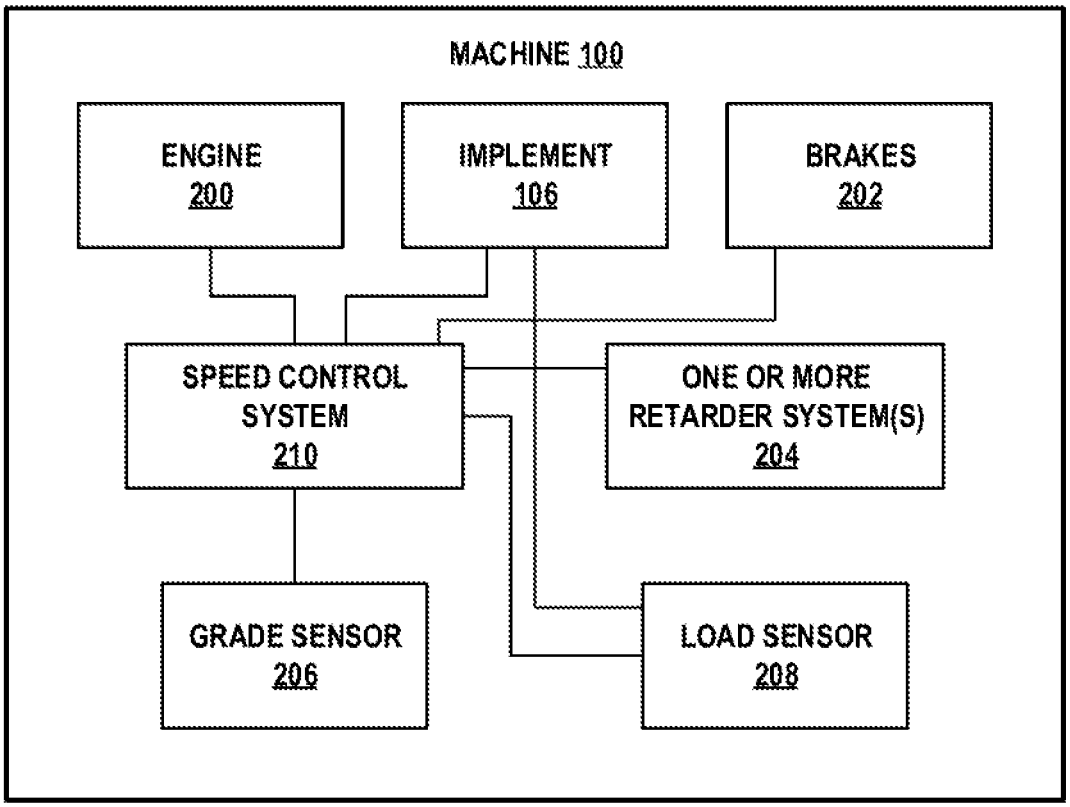
FIG. 2 is a block diagram depicting the example machine FIG. 1 and components thereof.

FIG. 2 is a block diagram depicting machine 100 and a number of subsystems thereof, including engine 200, implement 106, service brakes 202, one or more speed retarder systems 204, grade sensor 206, load sensor 208, and speed control system (SCS) 210. SCS 210 is configured to automatically control the speed of machine 100 under certain operating conditions thereof. As an example, SCS 210 can control the speed of machine 100 down a declined grade without application of the brakes of the machine.

SCS 210 is, as depicted schematically in FIG. 2, communicatively connected to implement 106, engine 200, retarder system(s) 204, grade sensor 206 and load sensor 208. SCS 210 can include software, hardware, and combinations of hardware and software configured to execute a number of functions related to automatically (e.g., without operator input) controlling the speed of machine 100. SCS 210 can be an analog, digital, or combination analog and digital controller including a number of components. As examples, SCS 210 can include integrated circuit boards or ICB(s), printed circuit boards PCB(s), processor(s), data storage devices, switches, relays, etcetera. Examples of processors can include any one or more of a microprocessor, a controller, a digital signal processor (DSP), an application specific integrated circuit (ASIC), a field-programmable gate array (FPGA), or equivalent discrete or integrated logic circuitry.

SCS 210 may include storage media to store and/or retrieve data or other information, for example, signals from sensors. Storage devices, in some examples, are described as a computer-readable storage medium. In some examples, storage devices include a temporary memory, meaning that a principal purpose of one or more storage devices is not long-term storage. Storage devices are, in some examples, described as a volatile memory, meaning that storage devices do not maintain stored contents when the computer is turned off. Examples of volatile memories include random access memories (RAM), dynamic random access memories (DRAM), static random access memories (SRAM), and other forms of volatile memories known in the art. The data storage devices can be used to store program instructions for execution by processor(s) of SCS 210. The storage devices, for example, are used by software, applications, algorithms, as examples, running on and/or executed by SCS 210. The storage devices can include short-term and/or long-term memory, and can be volatile and/or non-volatile. Examples of non-volatile storage elements include magnetic hard discs, optical discs, floppy discs, flash memories, or forms of electrically programmable memories (EPROM) or electrically erasable and programmable (EEPROM) memories.

SCS 210 can be configured to communicate with implement 106, engine 200, retarder system(s) 204, grade sensor 206 and load sensor 208 via various wired or wireless communications technologies and components using various public and/or proprietary standards and/or protocols. In some examples, SCS 210 and other components of machine 100 will communicate over a local wired communication and/or power network of machine 100. However, SCS 210 can also be configured to communicate wirelessly. Additionally, SCS 210 can be configured to use various transport mediums and protocols for communicating with components of machine 100, including, for example, Ethernet, Transmission Control Protocol/Internet Protocol (TCP/IP), 802.11 or Bluetooth, or other standard or proprietary communication protocols.

Machine 100 includes one or more speed retarder systems 204. A speed retarder system is a system on-board a machine that can slow the rate of travel of the machine by retarding or counteracting kinetic energy of the machine, whether generated by, e.g., gravity or by the engine of the machine, independent of application of mechanical braking to slow or stop rotation of the wheels of the machine. Examples of speed retarder systems 204 include engine fan retarding, hydraulic pumps retarding, transmission retarding, engine retarding, exhaust retarding, among other examples.

Each of retarder system(s) 204 is capable of retarding an amount of energy of machine 100 to slow or otherwise control the speed at which the machine travels. As such, each retarder system 204 has a retarding capability, which is the amount of energy the retarder system can dissipate in one or more systems of machine 100 powering or transmitting power to propel the machine. The respective retarding capabilities of retarder system(s) 204 can be constant or variable. The particular values of the retarding capabilities of retarder system(s) 204 can be stored in memory of SCS 210 or in other components, including in the retarder system, and then be communicated to SCS 210. SCS 210 (and other example devices in accordance with this disclosure) can use the retarding capability of retarder system(s) 204 to determine a retarder speed limit for machine 100 and to limit the speed at which the machine travels to the determined retarder speed limit without application of the service brakes of the machine.

Machine 100 also includes grade sensor 206 and load sensor 208. Grade sensor 206 measures the grade or angle (e.g., relative to ground/horizontal) at which machine 100 is disposed. Grade sensor 206 can include a number of different types of sensors, including, for example, accelerometer, inclinometer, tilt sensor, or another sensor for determining incline, decline, change in elevation, slope, orientation, or grade of machine 100. Grade sensor 206 can also include a global positioning system, an external input regarding the grade of machine 100 at the current position of the machine, or an input from another source. The grade of machine 100 may be measured and/or expressed as a percentage (%) grade of rise divided by run, with 0% grade being a flat slope of zero and a 100% grade being a steep slope of 1 foot rise over 1 foot run (1/1), or a 45 degree slope.

In one example, grade sensor 206 includes an inertial measurement unit. For example, grade sensor 206 can include one or more 6-degree of freedom (6 DOF) IMUS. A 6 DOF IMU can include of a 3-axis accelerometer, 3-axis angular rate gyros, and may optionally include a 2-axis inclinometer. The 3-axis angular rate gyros may provide signals indicative of the pitch rate, yaw rate, and roll rate of the machine 100. The 3-axis accelerometer may provide signals indicative of the acceleration of the machine 100 in the x, y, and z directions. The IMUs can be configured to generate signals indicative of a change in position/orientation of machine 100. In one example, grade sensor 206, SCS 210 or another component of machine 100 can compute or derive the grade of the machine from angular rates and acceleration of the machine 100.

Load sensor 208 measures a load of machine 100. The load of machine 100 can include the weight of the machine and also the load or weight of an external load on the machine. For example, the load of machine 100 can include a fixed weight of the machine when not carrying or transporting any external materials, like, for example, dirt or debris carried by bucket 112 of implement 106, plus the weight of dirt or other material carried by the implement. In some cases, the fixed, unloaded weight of machine 100 (sometimes referred to as "curb weight") is stored or input into systems of the machine, for example, into storage of SCS 210 and load sensor 208 measures and communicates the load on implement 106, which is added to the machine weight to determine the total load on the machine. Load sensor 208 can be a variety of sensors configured to measure force, including, for example, one or more load cells.

In an example, SCS 210 is configured to determine a retarder speed limit of machine 100 and to automatically limit the travel of speed of the machine to the determined retarder speed limit. As described above, there can be operational conditions of machine 100 under which it is advisable and/or beneficial to limit the speed at which the machine travels without application of brakes 202. In such circumstances, SCS 210 can automatically, e.g. without requiring input from or interaction by an operator, limit the speed of travel of machine 100 based on the grade at which the machine is disposed, the load on the machine, and the retarding capability of each of retarder system(s) 204.

For example, grade sensor 206 can measure, record and/or transmit signals indicative of the grade of machine 100 to SCS 210. Additionally, load sensor 208 can measure, record and/or transmit signals indicative of the load of machine 100. In some cases, the load of machine 100 can include a fixed machine weight without an external load plus a weight of any external load on the machine. SCS 210 can store and retrieve the fixed machine weight, or the fixed machine weight can be stored and/or determined by another component of machine 100 and communicated to SCS 210 along with a load measurement from load sensor, which measures a load on, for example, implement 106.

SCS 210 is configured to use the grade and load of machine 100 and the retarding capability of each of retarder system(s) 204 to determine a rate of travel of the machine that can be maintained by the retarder systems without application of brakes 202. For example, SCS 210 can determine a retarder speed limit of machine 100 as a speed that can be maintained by application of each of retarder system(s) 204 at a respective maximum retarding capability (or a fraction thereof for a built-in factor of safety) thereof at the current grade and load on the machine. SCS 210 can be configured to determine the speed limit of machine 100 using a variety of techniques, including SCS 210 referencing a look-up table, database, or other data storage and retrieval mechanism that correlates machine grades, loads, and retarding capabilities of on-board retarder system(s) 204.

After determining the retarder speed limit for machine 100, SCS 210 can also automatically limit the speed at which the machine travels to the determined limit. For example, SCS 210 can communicate with retarder system(s) 204 to cause the retarder systems to actuate to retard the speed of travel of machine 100 at the respective retarding capability of each of the retarder systems without application of brakes 202. In some cases, the retarder speed limit determined by SCS 210 may exceed a maximum or global speed limit of machine 100. In other words, under certain conditions, retarder system(s) 204 may not be capable of generating enough retarding energy to limit the speed of the machine to or below a desired or required threshold like a global speed limit threshold.

In an example, therefore, after determining the speed limit for machine 100 based grade, load and retarding capabilities, SCS 210 can be configured to compare the determined retarder speed limit to a global speed limit (or more generally to a threshold speed limit). In the event the determined speed limit exceeds the global speed limit, SCS 210 can be configured to execute a number of additional functions, including automatically actuating brakes 202 independent of or in concert with retarder system(s) 204 to bring the actual speed of machine 100 to or below the global speed limit. Alternatively or additionally, SCS 210 can trigger one or more alerts, for example, to alert the operator to apply brakes 202 manually.

Additionally or alternatively, in the event the determined retarding speed limit exceeds the global speed limit, SCS 210 can be configured to select the global speed limit and to attempt to control the speed of the machine to the global speed limit with retarder system(s) 204. In such cases, SCS 210 could attempt to control to the global speed limit using only retarder system(s) 204 and could, if unable to control machine speed to or below the global speed limit, trigger an alert for the operator and/or automatically actuating brakes 202 independent of or in concert with retarder system(s) 204 to bring the actual speed of machine 100 to or below the global speed limit.

Figure 3:
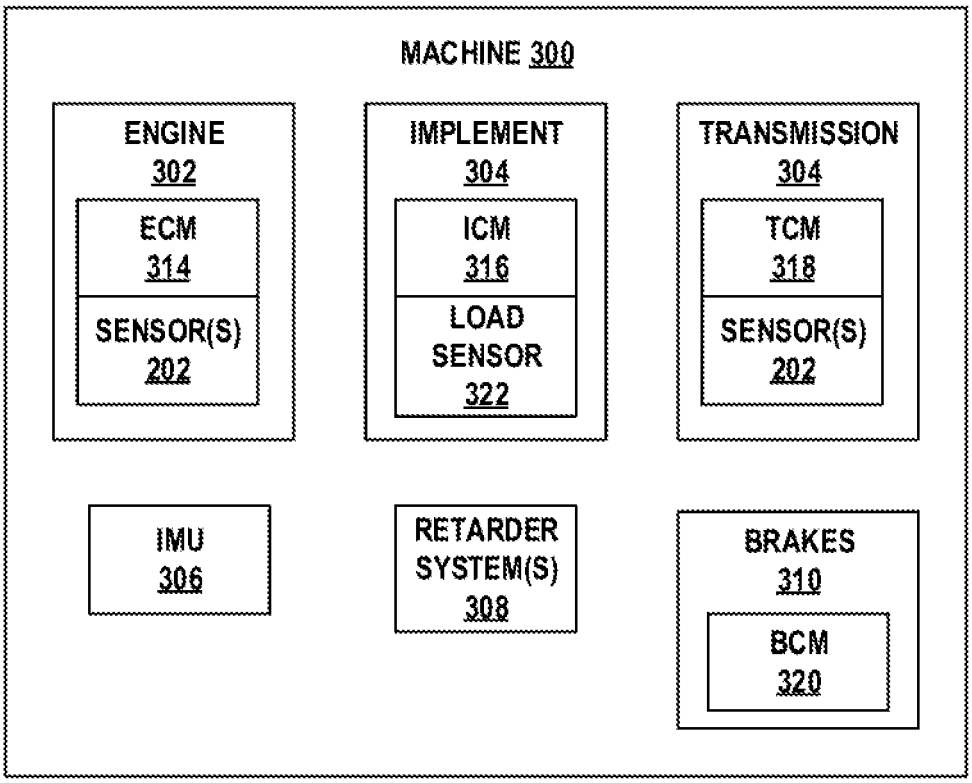
FIG. 3 is a block diagram schematically depicting another example machine in accordance with this disclosure.

FIG. 3 is a block diagram schematically depicting another example machine 300 in accordance with this disclosure. Machine 300 can be a variety of types of machines including, for example, trucks, cars, on-highway trucks, dump trucks, off-highway trucks, earth moving machines, wheel loaders, compactors, excavators, track type tractors, dozers, motor graders, wheel tractor-scrapers, or other moving machine. Machine 300 includes engine 302, implement 304, transmission 306, intertial measurement unit (IMU) 308, one or more retarder systems 310, and brakes 312.

Machine 300 includes a number of electronic control units. An electronic control unit (ECU) can be an embedded system that controls machine electrical systems and/or other subsystems of the machine. Types of ECUs include Electronic/engine Control Module, Powertrain Control Module, Transmission Control Module, Brake Control Module, Suspension Control Module, among other examples. In the case of industrial, construction, and other heavy machinery, example ECUs can also include an Implement Control Module associated with one or more implements coupled to and operable from the machine.

Example machine 300 includes Engine Control Module (ECM) 314 associated with engine 302, Implement Control Module (ICM) 316 associated with implement 304, Transmission Control Module (TCM) 318, and Brake Control Module (BCM) 320. One or more of ECM 314, ICM 316, TCM 318 and BCM 320 can be communicatively connected and configured to send and receive data, sensor or other analog signals, and other information between the various ECUs of machine 300.

The ECUs of machine 300, including ECM 314, ICM 316, TCM 318 and BCM 320 can include software, hardware, and combinations of hardware and software configured to execute a number of functions attributed to the components in the disclosed examples. The ECUs of machine 300 can be an analog, digital, or combination analog and digital controllers including a number of components. As examples, the ECUS of machine 300 can include integrated circuit boards or ICB(s), printed circuit boards PCB(s), processor(s), data storage devices, switches, relays, etcetera. Examples of processors can include any one or more of a microprocessor, a controller, a digital signal processor (DSP), an application specific integrated circuit (ASIC), a field-programmable gate array (FPGA), or equivalent discrete or integrated logic circuitry.

The ECUs of machine 300 may include storage media to store and/or retrieve data or other information, for example, signals from sensors. Examples of non-volatile storage devices include magnetic hard discs, optical discs, floppy discs, flash memories, or forms of electrically programmable memories (EPROM) or electrically erasable and programmable (EEPROM) memories. Examples of volatile storage devices include random access memories (RAM), dynamic random access memories (DRAM), static random access memories (SRAM), and other forms of volatile storage devices. The data storage devices can be used to store program instructions for execution by processor(s) of, for example, ECM 314, ICM 316, TCM 318 and/or BCM 320.

ECM 314, ICM 316, TCM 318 and/or BCM 320 can be configured to communicate with one another and with other components of machine 300 via various wired or wireless communications technologies and components using various public and/or proprietary standards and/or protocols. Examples of transport mediums and protocols for electronic communication between components of machine 300 include Ethernet, Transmission Control Protocol/Internet Protocol (TCP/IP), 802.11 or Bluetooth, or other standard or proprietary transport mediums and communication protocols.

In the example of FIG. 3, machine 300 includes load sensor 322, which is associated with implement 304 and ICM 316. Load sensor 322 can be configured to communicate with ICM 316, for example, send machine and/or implement load measurements or signals indicative of such measurements to ICM 316. Additionally, grade sensor 322 can be configured to communicate directly with other ECUs of machine 300, including ECM 314, TCM 318, and BCM 320.

Machine 300 also includes IMU 306. IMU 306 can be configured to measure a grade at which machine 300 is disposed. For example, IMU 306 can be configured to generate signals indicative of the angle at which machine 300 is disposed relative to some reference datum, for example relative to ground/horizontal. IMU 306 can include one or more sensors, from which IMU 306 can measure, calculate, and/or derive the grade of machine 300. For example, IMU 306 can include one or more accelerometers, gyroscopes, inclinometers, and/or other sensors. Similar to the example of grade sensor 206 described with reference to the example of FIGS. 1 and 2, can include a multi degree of freedom IMU, which can compute or derive the grade of machine 300 from various measurements of the sensors included therein. IMU can be configured to communicate with the ECUs of machine 300, including ECM 314, ICM 316, TCM 318, and BCM 320.

Machine 300 includes one or more retarder systems 308 and brakes 310. Retarder system(s) 308 are configured to be actuated to modulate the speed at which machine 300 travels independent of application of brakes 310, which brakes can be manually actuated by an operator or automatically actuated by BCM 320 to slow or stop the machine. Brakes 310 can be operatively coupled to one or more wheels of machine 300 and can include, as examples, friction brakes like drum or disc brakes. In an example, retarder system(s) 308 of machine 300 includes an engine retarder system, a transmission retarder system, and an exhaust retarder system.

The engine retarder system may also be referred to as an engine brake, compression brake, or Jake brake. The engine retarder is a device or system, which retards or slows engine 302 and machine 300 by dissipating energy. The engine retarder can, for example, open or actuate an exhaust valve of engine 302 near top dead center of the compression stroke, thereby releasing compressed air into the exhaust to dissipate energy and slow machine 300.

The transmission retarder is a device or system configured to dissipate energy in the driveline of machine 300. The transmission retarder can, for example, operate one or more hydraulic pumps attached to transmission 304 to dissipate energy. The transmission retarder can transfer fluid (hydraulic, transmission, or another available fluid) into a chamber spinning with the transmission 304. The chamber may include vanes or other structures. When the fluid is added to the chamber viscous drag is applied to transmission 304, which dissipates energy and slows machine 300. The transmission retarder can also operate an electric motor, heater, or generator connected to transmission 304 and/or drive shafts of machine 300 to dissipate energy and thereby slow the speed of the machine.

Retarder system(s) 308 can also include an exhaust retarder or exhaust brake. The exhaust retarder can be configured to add a controlled and/or selected restriction in the exhaust system or an electric retarder, which uses electromagnetic induction to apply a retarding force to a flywheel, transmission 304, and/or drive shafts of machine 300. Such retarder devices/systems can also include a fan that is controlled to spin up to add load, and also implement pumps that stroke up and blow pressure over relief to additionally dissipate load, or other devices capable of dissipating load.

Machine 300 is configured to automatically control the speed at which the machine travels using retarder systems 308 and without application of brakes 320. In an example, machine 300 is configured to determine a speed limit value for the machine based on a measurement of the machine grade from IMU 306, a machine load at least part of which is provided by load sensor 322, and the retarding capability of each of retarder system(s) 308, for example, a retarding capability for the engine retarder, transmission retarder, exhaust retarder, implement retarder and fan retarder.

In an example, various control systems of machine 300, including, for example, ECM 314 and TCM 318 are configured with a number of threshold or target parameter values related to the operation of the machine. For example, ECM 314 and/or TCM 318 can be configured with a global forward speed limit and a global reverse speed limit, the values of which may be the same or different. The global speed limits provide an upper limit on the speed of machine 300 as controlled by systems thereof, for example, as controlled by ECM 314 and/or TCM 318. These limits or thresholds are referred to as global to indicate that they can be used to limit the speed of machine 300 regardless of other speed control measures implemented on the machine, including the automatic retarder speed control systems/devices/methods in accordance with examples of this disclosure. Additionally, TCM 318 may be configured with additional thresholds, including, as an example, gear speed limits for each drive gear of transmission 304. ECM 314 and/or TCM 318, as well as other controls or components of machine 300 can be configured to limit the speed at which the machine travels using retarder system(s) 308 and without application of brakes 310 based on machine grade, load and retarder system capability and taking into account the global and gear speed limits of the machine.

In an example, IMU 306 continuously or periodically measures the grade at which machine 300 is disposed. IMU 306 may store machine grade measurements/signals indicative thereof. IMU 306 can send machine grade data to TCM 318.

In an example, machine 300 has a curb weight that is fixed and represents the weight of the machine when not carrying a load with implement 304. Load sensor 322 is configured to measure and store and/or transmit signals indicative of a load on implement 304. In an example, ICM 316 or TCM 318 is configured to receive the signals from load sensor 322 and determine a total machine load based on the implement load and the machine curb weight. In an example, load sensor 322 continuously or periodically samples the load on implement 304 and transmits signals indicative of the implement load to ICM 304. ICM 304 transmits the implement load to TCM 318 and TCM 318 determines a total machine load by adding the implement load received from ICM 304 and the machine curb weight, for example, stored in memory of TCM 318.

In an example, an automatic retarder speed control program, circuit, algorithm or other electronic control is implemented in TCM 318. TCM 318 can be configured with the number and type of retarder system(s) 308 of machine 300 and can also store, calculate, derive, etc. a retarding capability for each of retarder system(s) 308.

TCM 318 can employ the grade and load of machine 300 and the retarding capability of each of retarder system(s) 308 to determine a retarder speed limit for machine 300. In an example, TCM 318 receives the machine grade from IMU 306, receives the implement load from ICM 316 and calculates a total machine load from the implement load and fixed machine curb weight stored in memory of TCM 318. TCM 318 employs a look-up table, database, or other data storage and retrieval mechanism to determine a speed of travel of machine 300 that can be maintained at the current grade and load using retarder system(s) 308 without application of brakes 310. For example, TCM 318 can be configured with a table or other mechanism, e.g., algorithm, which, given a machine grade and load and total retarding capability all retarder systems on-board machine 300, solves for a speed limit that can be maintained by actuation/application of the retarder systems without application of brakes 310.

Additionally, in an example, TCM 318 determines a current drive gear of machine 300 and compares the retarder speed limit to a gear speed limit for the active drive gear. In the event that the retarder speed limit is less than the gear speed limit, TCM 318 will limit machine 300 to the retarder speed limit. If, however, the retarder speed limit exceeds the gear speed limit, TCM 318 will then compare the gear speed limit to the global speed limit of machine 300 and can, alone or in conjunction with other electronic controls, e.g., ECM 314, limit the speed of machine 300 to the lesser of the gear limit and the global speed limit. In the event, the retarder speed limit exceeds the global speed limit, TCM 318 may need to communicate with and actuate both retarder system(s) 308 and brakes 310 (or, in the case of brakes 310, TCM 318 may communicate with BCM 320, which, in turn, actuates brakes 310).

Figure 4:
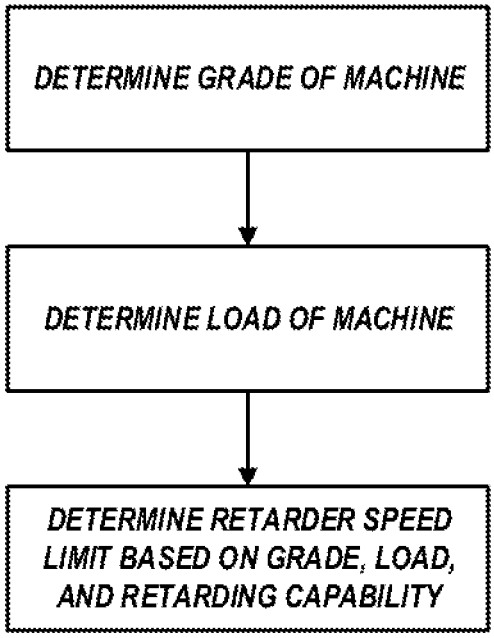
FIG. 4 is a flowchart depicting an example method of determining a retarder speed limit for a machine.

FIG. 4 is a flowchart depicting an example method of determining a retarder speed limit of a machine in accordance with this disclosure. In FIG. 4, method 400 includes determining a grade at which the machine is disposed using a grade sensor coupled to the machine (402), determining a load of the machine using a load sensor coupled to the machine (404), determining, by a controller in electrical communication with a machine engine, a retarder speed limit based on the grade, the load and a retarding capability of each of the one or more retarder systems (406). The retarder speed limit is a speed that can be maintained by actuation of the one or more retarder systems without actuating a machine braking system of the machine. The retarding capability of each of the one or more retarder systems is an amount of energy the respective retarder system can dissipate in one or more systems of the machine powering or transmitting power to propel the machine. The method of FIG. 4 is applicable to example machines 100 and 300 and other examples in accordance with this disclosure.

In an example of method 400, a speed control system (SCS) of the machine is configured to determine a retarder speed limit for the machine, and, optionally, to automatically limit the travel of speed of the machine to the determined retarder speed limit. For example, the grade sensor can measure, record and/or transmit signals indicative of the grade of the machine 100 to the SCS. Additionally, the load sensor can measure, record and/or transmit signals indicative of the load of the machine. The SCS is configured to use the grade and load of the machine and the retarding capability of each of the retarder system(s) to determine a rate of travel of the machine that can be maintained by the retarder systems without application of machine brakes. After determining the retarder speed limit, the SCS (or another or one or more other electronic devices/systems, including, for example, one or more ECUs of the machine) can also automatically limit the speed at which the machine travels to the determined retarder speed limit.

INDUSTRIAL APPLICABILITY

Example machines in accordance with this disclosure can be used in a variety of industrial, construction, commercial or other applications. Example machines can be operated by an operator from a cabin of the machine. The operator can, for example, drive the machine to and from various locations on a work site, as well as between different sites, and can also pick up and deposit loads of material using a bucket implement or accomplish other tasks to which the machine and/or implements thereof are adapted. As an example, the machine can be used to excavate a portion of a work site by articulating a bucket implement to dig into and remove dirt, rock, sand, or other detritus from a portion of the work site and deposit this load in another location.

As the machine moves from various locations, the machine may be required to traverse various grades including downhill or decline grades. As the weight of the machine and the loads thereon can be large, application of the service brakes of the machine can cause rapid wearing of the brake system, especially when applying the brakes on a downhill grade. To extend brake life and to provide additional means of controlling speed, the machine can include a number of speed retarder systems, which are configured to retard the speed of the machine independent of use of the brakes to control machine speed.

The machine can therefore include a speed control system that is configured to automatically control the speed at which the machine travels. For example, the machine includes an engine, the speed retarder system(s), and can also include a grade sensor configured to measure a grade at which the machine is disposed and a load sensor configured to measure a load on the machine. Each of the retarder systems has a retarding capability that can be equal to an amount of energy the respective retarder system can dissipate in one or more systems of the machine powering or transmitting power to propel the machine, for example, the engine and transmission.

The speed control system of the machine is in electrical communication with the engine, the one or more retarder systems, the grade sensor, and the load sensor. The speed control system can be configured to determine a retarder speed limit based on the grade, the load and the retarding capability of each of the one or more retarder systems and can also be configured to automatically limit the speed of machine to the determined retarder speed limit using the one or more machine retarder systems without actuating the braking system of machine.

In one situation, the operator of the machine may be traversing a steep downhill grade in the machine, while carrying a load of material with a bucket of an implement. The operator may or may not be actuating the machine service brakes, the retarder system(s), or actuating a throttle, but, regardless, the speed control system (e.g., one or more ECUs of the machine) of the machine can determine the load and grade of the machine, and retrieve from memory or receive from another component the retarding capabilities of the retarder system(s). The control system can determine a speed that can be maintained for the determined machine load and grade using the retarder system(s) without actuating the brakes. The speed control system can also automatically, e.g., without requiring action by the operator, limit the actual speed of travel of the machine down the steep grade to this determined retarder speed limit by actuating the retarder system(s) and without actuating the brakes.

The above detailed description is intended to be illustrative, and not restrictive. The scope of the disclosure should, therefore, be determined with references to the appended claims, along with the full scope of equivalents to which such claims are entitled.

What is claimed is:

1. A machine comprising:

an engine;

one or more machine retarder systems, each of which has a retarding capability comprising an amount of energy the respective retarder system can dissipate in one or more systems of the machine powering or transmitting power to propel the machine;

a grade sensor configured to measure a grade at which the machine is disposed;

a load sensor configured to measure a load on the machine; and a controller in electrical communication with the engine, the one or more retarder systems, the grade sensor, and the load sensor, the controller determining a retarder speed limit based on the grade, the load and the retarding capability of each of the one or more retarder systems, the retarder speed limit being a speed of the machine that can be maintained by actuation of the one or more retarder systems without actuating a machine braking system.

2. The machine of claim 1, the controller automatically limiting a speed of the machine to the determined retarder speed limit using the one or more retarder systems without actuating the machine braking system.

3. The machine of claim 1, the controller comparing the retarder speed limit to one or more thresholds.

4. The machine of claim 3, wherein the one or more thresholds comprises a global speed limit, and the controller comparing the retarder speed limit to and automatically limiting a speed of the machine to the lesser of the determined retarder speed limit and the global speed limit.

5. The machine of claim 1, further comprising a transmission system operatively coupled to and configured to control delivery of power to the machine from the engine, the transmission system comprising at least one transmission sensor configured to determine an active drive gear of the transmission system, and the controller automatically limiting a speed of the machine to a gear speed limit based on the active drive gear.

6. The machine of claim 5, the controller comparing the determined retarder speed limit to the gear speed limit and automatically limiting a speed of the machine to the lesser of the determined machine speed limit and the gear speed limit.

7. The machine of claim 1, further comprising a transmission system operatively coupled to and configured to control delivery of power to the machine from the engine, wherein the controller comprises a transmission control module (TCM) of the transmission system.

8. The machine of claim 7, further comprising an implement control module (ICM) of a load bearing implement system of the machine, the ICM communicatively coupled to the load sensor and the TCM and configured to transmit the load from the load sensor to the TCM.

9. The machine of claim 8, the ICM determining the load by adding an implement load measured by the load sensor to a machine weight.

10. The machine of claim 9, the ICM periodically determining and sending data, signals, or other information indicative of the load to the TCM.

11. The machine of claim 7, the grade sensor periodically measuring and sending data, signals, or other information indicative of the grade to the TCM.

12. The machine of claim 7, further comprising an engine control module (ECM) and ICM, the TCM, after determining the retarder speed limit, sends one or more command signals to the retarder systems to apply resistive load to automatically limit the speed of the machine to the determined retarder speed limit using the one or more machine retarder systems without actuating the machine braking system.

13. The machine of claim 7, the TCM automatically limiting a speed of the machine to the determined retarder speed limit using the one or more machine retarder systems without actuating the machine braking system.

14. The machine of claim 7, the TCM comparing the retarder speed limit to one or more thresholds.

15. The machine of claim 14, wherein the threshold comprises a gear speed limit for each drive gear of the transmission system and a global speed limit, and the TCM comparing the retarder speed limit to at least one of a gear speed limit for an active drive gear of the machine and the global speed limit.

16. The machine of claim 15, the TCM being configured to:

compare the determined retarder speed limit to the gear speed limit for an active drive gear of the machine and to the global speed limit; and select the slowest of the retarder, gear and global speed limit to automatically limit the speed of the machine.

17. The machine of claim 1, wherein the one or more machine retarder systems comprises one or more of:

a fan retarder system;

a hydraulic retarder system;

an electric retarder system;

a transmission retarder system;

an engine retarder system; and an exhaust retarder system.

18. A method of operating a machine, the method comprising:

determining a grade at which the machine is disposed using a grade sensor coupled to the machine;

determining a load of the machine using a load sensor coupled to the machine; and determining, by a controller in communication with one or more retarder systems, the grade sensor, and the load sensor, a retarder speed limit based on the grade, the load and a retarding capability of each of the one or more retarder systems, wherein the retarding capability of each of the one or more retarder systems is an amount of energy the respective retarder system can dissipate in one or more systems of the machine powering or transmitting power to propel the machine, and wherein the retarder speed limit is equal to a speed of the machine that can be maintained by actuation of the one or more retarder systems without actuating a machine braking system.

19. The method of claim 18, further comprising:

automatically limiting a speed of the machine to the determined retarder speed limit using the one or more retarder systems without actuating the machine braking system.

20. A machine comprising:

an engine;

one or more machine retarder systems, each of which has a retarding capability comprising an amount of energy the respective retarder system can dissipate in one or more systems of the machine powering or transmitting power to propel the machine;

a grade sensor configured to generate one or more grade signals indicative of a grade at which the machine is disposed;

a load sensor configured to generate one or more load signals indicative of a load on the machine; and an electronic control unit (ECU) configured to:

receive the one or more grade signals, the one or more load signals, and receive or retrieve the retarding capability of each of the one or more retarder systems;

determine a retarder speed limit based on the grade signals, the load signals and the retarding capability of the one or more retarder systems; and automatically limiting a speed of the machine to the determined retarder speed limit using the one or more machine retarder systems without actuating the machine braking system.

* * * * *